US006769954B2

(12) United States Patent
Su

(10) Patent No.: US 6,769,954 B2
(45) Date of Patent: Aug. 3, 2004

(54) CHRISTMAS DEER TOY CAPABLE OF MOVING HEAD, NECK, AND TAIL

(76) Inventor: Lien Cheng Su, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/336,165

(22) Filed: Jan. 6, 2003

(65) Prior Publication Data

US 2004/0132378 A1 Jul. 8, 2004

(51) Int. Cl.[7] ..... A63H 7/00; A63H 11/00; A47G 33/04; G09F 19/08

(52) U.S. Cl. ..... 446/353; 446/356; 428/8; 40/414

(58) Field of Search ..... 446/330, 353, 446/356, 370, 371, 373, 352, 376, 375, 374, 323; 40/414, 418, 419, 540, 550; 428/7–9, 12, 158; 362/252

(56) References Cited

U.S. PATENT DOCUMENTS 4,820,232 A * 4/1989 Takahashi et al. ..... 446/178
4,867,730 A * 9/1989 Lee ..... 446/353
5,379,202 A * 1/1995 Daun ..... 362/252
5,451,436 A * 9/1995 Shelleman ..... 428/8
5,766,701 A * 6/1998 Lee ..... 428/9
5,850,927 A * 12/1998 Pan ..... 211/181.1
5,931,715 A * 8/1999 Chang ..... 446/158
6,350,170 B1 * 2/2002 Liu ..... 446/353
6,413,594 B1 * 7/2002 Onishi ..... 428/7
6,478,164 B1 * 11/2002 Pan ..... 211/1.51

* cited by examiner

*Primary Examiner*—Jacob K. Ackun
*Assistant Examiner*—Faye Francis

(57) ABSTRACT

A Christmas deer toy is capable of moving the head, neck, and tail thereof. The body unit, head unit, neck unit, and tail unit are pivotally connected. By a driving unit, the parts can move vividly to simulate the action of an animal. The driving unit includes a motor, a rotary arm, a main driving arm, a tail driven arm, and a head driven arm. Only a few components are used and the structure is simple. A rear end of the neck unit has an extending arm and a weight for assisting the actions of the head unit and neck unit to be more vivid.

1 Claim, 5 Drawing Sheets

CHRISTMAS DEER TOY CAPABLE OF MOVING HEAD, NECK, AND TAIL

FIELD OF THE INVENTION

The present invention relates to movable decorations, and particularly to a Christmas deer toy capable of moving the head, neck, and tail thereof.

BACKGROUND OF THE INVENTION

Deer presents luckiness, an thus they are especially used in Christmas as a decoration. In prior arts, deer decorations are static. Afterwards, deer decorations are added with function of movement, but in general, the movement of the deer is dull. Only a part of the deer decoration is movable, even the motion is simple. Thereby, the action of the deer is mechanical and is not like a practical animal.

Some movable deer are improved to present more vivid actions but the structure is very complicated and thus many components are used so that costs in parts and labors are high.

SUMMARY OF THE INVENTION

Accordingly, the primary object of the present invention is to provide a Christmas deer toy with a movable head, a movable neck, and a movable tail, wherein the body unit, head unit, neck unit, and tail unit are pivotally connected. By a driving unit, the parts can move vividly to simulate the action of an animal.

Another object of the present invention is to provide a Christmas deer toy capable of moving the head, neck, and tail thereof, wherein the driving unit includes a motor, a rotary arm, a main driving arm, a tail driven arm, and a head driven arm. Only a few components are used and the structure is simple.

A further object of the present invention is to provide a Christmas deer toy capable of moving the head, neck, and tail thereof, wherein a rear end of the neck unit has an extending arm and a weight for assisting the actions of the head unit and neck unit so as to act vividly.

The various objects and advantages of the present invention will be more readily understood from the following detailed description when read in conjunction with the appended drawing.

DETAILED DESCRIPTION OF THE PREFERRED EMBODIMENTS

Figure 1:
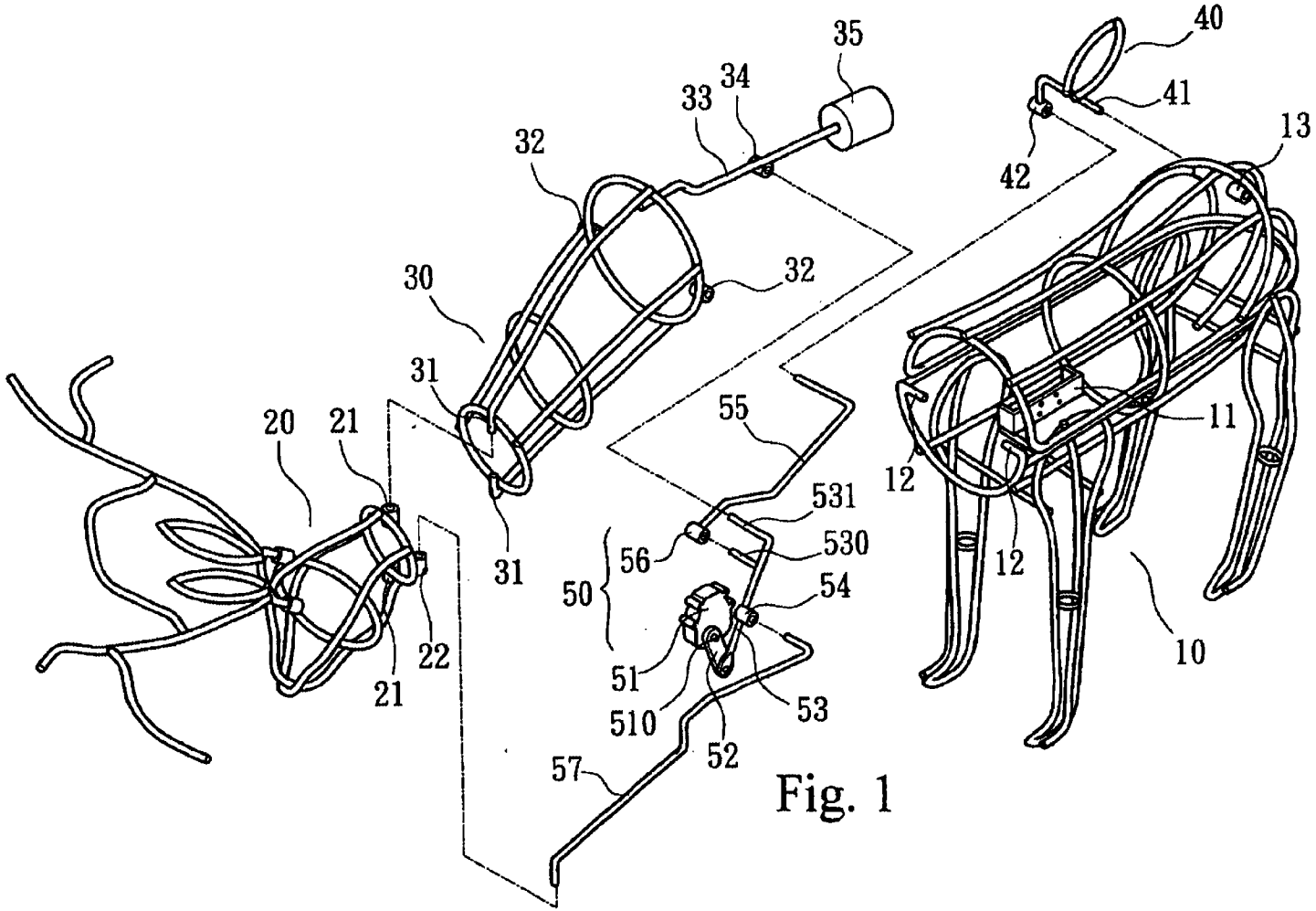
FIG. 1 is an exploded perspective view of the present invention.
Figure 2:
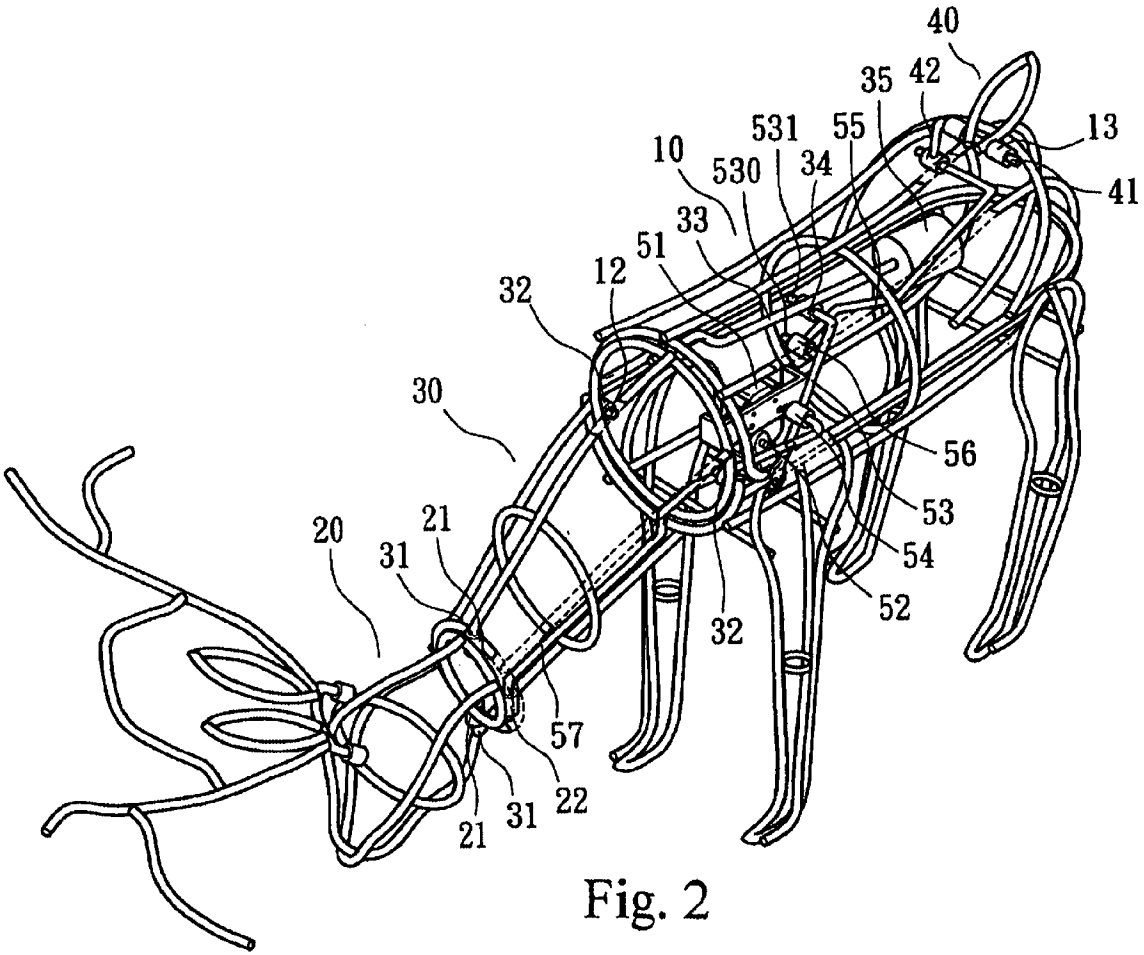
FIG. 2 is an assembled perspective view of the present invention.

Referring to FIGS. 1, 2, 3 and 4, the Christmas deer toy capable of moving the head, neck, and tail thereof of the present invention is illustrated. The Christmas deer toy capable of moving the head, neck, and tail thereof includes a body unit 10, a neck unit 30, a head unit 20 a tail unit 40, and a driving unit 50.

The body unit 10 is made by bending and welding a plurality of metal rods. A retaining seat 11 is installed therein for fixing a motor 51. Two sides of a front end of the body unit 10 have respective linkages 12 for being pivotally connected to the neck unit 30. A rear end of the body unit 10 is installed with a pivotal end 13 for being connected to the tail unit 40.

The neck unit 30 is made by bending and welding a plurality of metal rods. A front end of the neck unit 30 is installed with an upper and a lower linkage rods 31 for being pivotally connected to the head unit 20. Two sides of the rear end of the neck unit 30 are installed with respectively pivotal rings 32 for being pivotally connected to the linkages 12 at the front end of the body unit 10. Moreover, an extending arm 33 is extended from the pivotal ring 32. A middle section of the extending arm 33 is mounted with a driving pivotal end 34 and a distal end has a weight 35.

The head unit 20 is made by bending and welding a plurality of metal rods. A rear end of the head unit 20 is installed with an upper pivotal block 21 and a lower pivotal block 21 for being pivotally connected to the linkage rods 31 of the neck unit 30 and one lateral side of the rear end of the head unit 20 is mounted with a lateral pivotal block 22.

The tail unit 40 is formed by bending and welding metal rods. A front end of the tail unit 40 is a connecting rod 41 with a pivotal portion 42. The connecting rod 41 is pivotally connected to the pivotal end 13 of the body unit 10.

The driving unit 50 contains a motor 51, a rotary arm 52, a main driving arm 53, a tail driven arm 55, and a head driven arm 57. The motor 51 is fixed to the retaining seat 11 of the body unit 10. One end of the rotary arm 52 is fixed to a rotary shaft of the motor 51 and another end of the rotary arm 52 is pivotally connected to the main driving arm 53. A middle section of the main driving arm 53 is installed with a neck pivotal connecting end 54 and a distal end of the main driving arm 53 is installed with a distal connecting rod 530 and a neck connecting rod 531. A front end of the head driven arm 57 is pivotally connected to the lateral pivotal block 22 and a rear end of the head driven arm 57 is pivotally connected to a neck pivotal connecting end 54 of the main driving arm 53. The distal connecting rod 530 of the main driving arm 53 is pivotally connected to the driving pivotal end 34 on the extending arm 33 of the neck unit 30. A front end of the tail driven arm 55 has a pivotal means 56 which is pivotally connected to the distal connecting rod 530 of the main driving arm 53 and a rear end of the tail driven arm 55 is pivotally connected to the pivotal portion 42 of the tail unit 40.

The operation of the present invention will be described herein.

When the motor 51 is operated, the rotary shaft 510 rotates to drive a rotary arm. Moreover, following actions will be generated.

Figure 3:
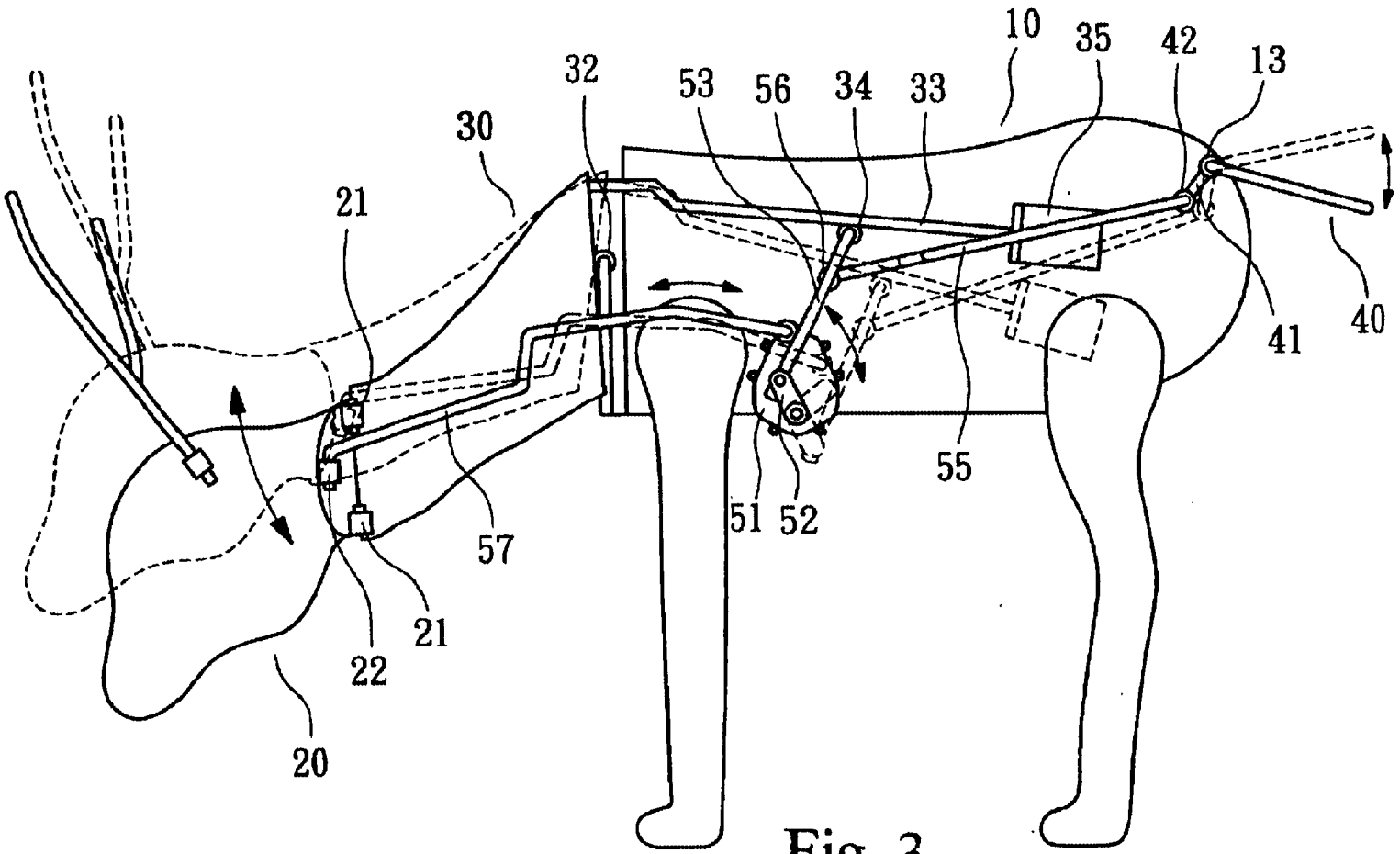
FIG. 3 is a schematic view showing one action of the present invention.

The head unit 20, neck unit 30 and tail unit 40 can swing upward and downward, as shown in FIG. 3. The rotary arm 52 rotates so that S the main driving arm 53 displaces so as to generate pull forces and push forces. By the distal connecting rod 530 to be pivotally connected to the driving pivotal end 34 of the extending arm 33 of the neck unit 30, the extending arm 33 is pulled downwards or ejects the extending arm 33 to move upwards. Thereby, the neck unit 30 and the head unit 20 move upwards or downwards to present an action of nod. Meanwhile, since the distal connecting rod 530 of the main driving arm 53 is pivotally connected to the tail driven arm 55 and then is pivotally connected to the tail unit 40, the tail connecting rod 530 displaces upward and downward to present an action of swing the tail. Namely, the pivotal portion 32 of the neck unit 30 can move upward or downwards by using the pivotal portion to the linkage 12 of the body unit 10 as a fulcrum.

Figure 4:
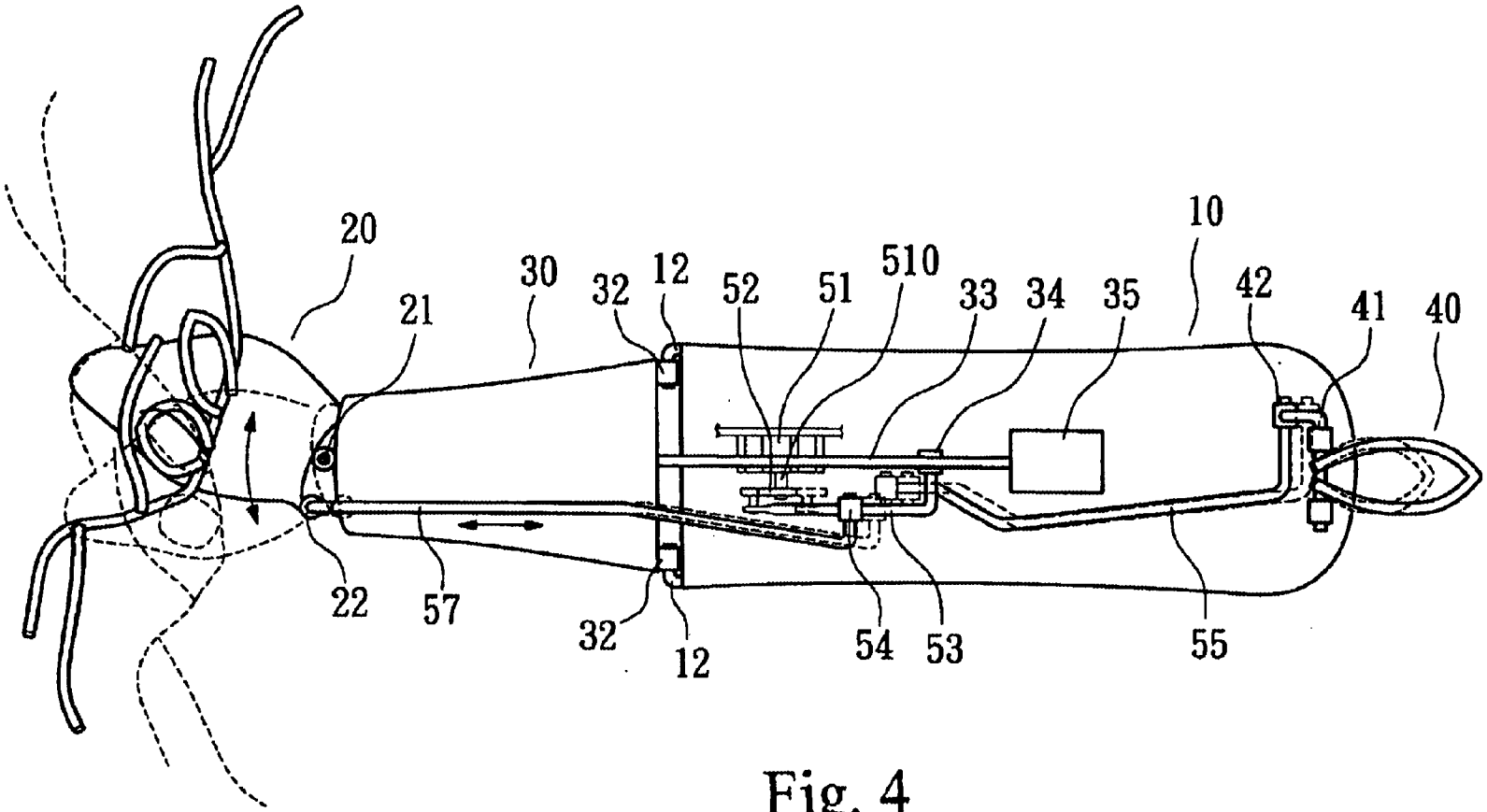
FIG. 4 is a schematic view showing another action of the present invention.

The head unit 20 can move leftwards or rightwards, as shown in FIG. 4. When the rotary arm 52 and the main driving arm 53 rotates, since the rear end of the head driven arm 57 is pivotally connected to the neck pivotal connecting end 54 of the main driving arm 53. A front end of the head driven arm 57 is eccentrically connected to the lateral pivotal block 22 of the head unit 20 so as to pull the head driven arm 57 to move forwards or backwards. Since the connection is eccentric, thus the head unit 20 can rotate leftwards or rightwards. In detail, the bead unit 20 can swing around the lower linkage rod 31 so as to present an effect of shaking head.

The effect of the weight 35 will be described herein. The neck unit 30 and the head unit 20 are inclined downwards. A downward force will generate. The weight 35 at the distal end of the extending arm 33 is heavy so as to generate a downward force at a rear end. Thereby, seesaw effect is generated so that the head unit 20 and neck unit 30 easily move up and down.

Figure 5:
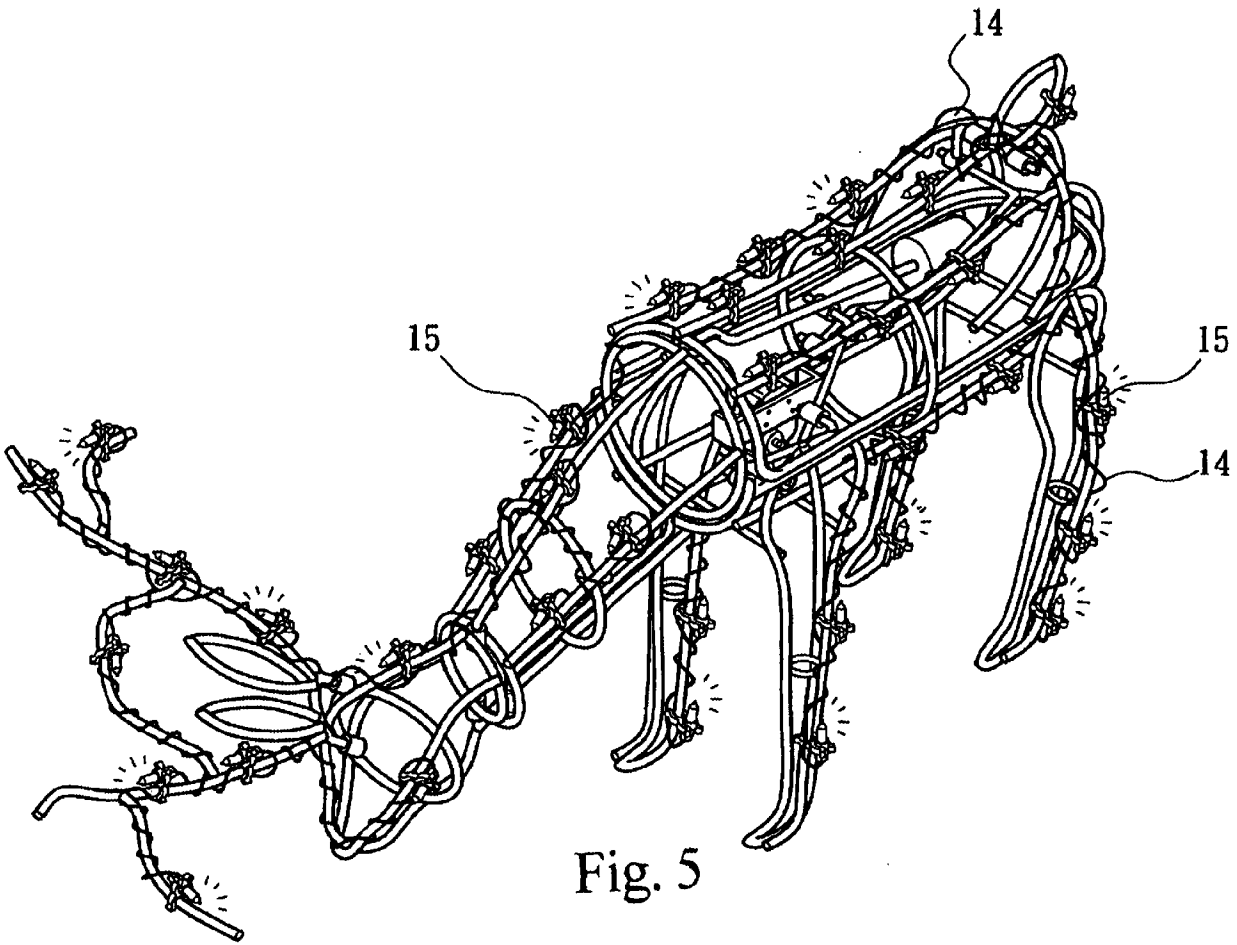
FIG. 5 is a schematic view showing that light effect is arranged in the present invention.

It is appreciated from above description that in the present invention, the motor 51 is installed with the driving unit 50. The driving unit 50 is formed by a main driving arm 53, a head driven arm 57, and a tail driven arm 55. Thereby, the head, neck and tail can present the action of nodding head, shaking head, and shaking tail by only a few components and a simple structure so as to present a vivid shape. Moreover, as shown in FIG. 5, by arranging electric wires 14 and bulbs 15, the Christmas deer toy capable of moving the head, neck, and tail thereof of the present invention can be as a beautiful artistic production.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A Christmas deer toy capable of moving a head, a neck, and a tail thereof; the Christmas deer toy comprising:

a body unit having a retaining seat; two sides of a front end of the body unit having respective linkages; a rear end of the body unit having a pivotal end;

a neck unit having a front end and a rear end; the front end of the neck unit having an upper linkage rod and a lower linkage rod; the rear end of the neck unit having a pivotal ring; and the pivotal ring of the neck unit being pivotally connected to the linkages at the front end of the body unit; an extending arm extending from the pivotal ring; a middle section of the extending arm being mounted with a driving pivotal end and a distal end of the extending arm having a weight;

a head unit pivotally connected to the upper linkage rod and the lower linkage rod of the neck unit; a rear end of the head unit having an upper pivotal block and a lower pivotal block, and two lateral sides of the head unit have lateral pivotal blocks, respectively; by the upper and lower pivotal blocks, the head unit being pivotally connected to the linkage rods of the head unit;

a tail unit; a front end of the tail unit having a connecting rod and a pivotal portion; the connecting rod being pivotally connected to the pivotal end of the body unit; and a driving unit containing;

a motor fixed to the retaining seat of the body unit;

a rotary arm; one end of the rotary arm being fixed to a rotary shaft of the motor;

a main driving arm; another end of the rotary arm being pivotally connected to the main driving arm; a middle section of the main driving arm being installed with a neck pivotal connecting end and a distal end of the main driving arm being installed with a distal connecting rod and a neck connecting rod;

two head driven arms; a front end of each of the head driven arms being pivotally connected to a respective one of the lateral pivotal block and a rear end of each of the head driven arms being pivotally connected to the neck pivotal connecting end; the distal connecting rod of the main driving arm being pivotally connected to the driving pivotal end on the extending arm of the neck unit;

a tail driven arm; a front end of the tail driven arm having a pivotal means; the pivotal means being pivotally connected to the distal connecting rod of the main driving arm and a rear end of the tail driven arm being pivotally connected to the pivotal portion of the tail unit;

wherein by above components, when the motor of the driving unit is actuated, the rotary arm, the main driving arm, the tail driven arm, the head driven arm, and the extending arm will move so that the head unit, the neck unit 30, and the tail unit move.

* * * * *